United States Patent [19]

Kasama

[11] 3,975,896

[45] Aug. 24, 1976

[54] SWITCHING DEVICE FOR ELECTRONIC TIMEPIECE

[75] Inventor: Noriyuki Kasama, Kodaira, Japan

[73] Assignee: Citizen Watch Co., Ltd., Tokyo, Japan

[22] Filed: Dec. 20, 1974

[21] Appl. No.: 534,839

[30] Foreign Application Priority Data

Dec. 24, 1973 Japan ..... 48-143578

[52] U.S. Cl. ..... 58/23 R; 58/23 BA; 58/50 R; 200/6 R

[51] Int. Cl.[2] ..... G04C 3/00; H01H 19/00

[58] Field of Search ..... 58/23 R, 23 BA, 34, 58/85.5, 63, 57.5, 50 R, 38; 200/6 BB, 6 R, 6 C, 6 B, 6 BA, 153 LB

[56] References Cited

UNITED STATES PATENTS

| | | | |
|---|---|---|---|
| 3,359,392 | 12/1967 | Heath | 200/6 R X |
| 3,666,902 | 5/1972 | Owen et al. | 200/6 R X |
| 3,719,788 | 3/1973 | Holland et al. | 200/6 BB X |
| 3,832,843 | 9/1974 | Wuthrich | 58/57.5 |
| 3,841,081 | 10/1974 | Komaki | 58/85.5 X |
| 3,874,162 | 4/1975 | Boxberger et al. | 58/85.5 X |

*Primary Examiner*—Ulysses Weldon
*Attorney, Agent, or Firm*—Spensley, Horn & Lubitz

[57] ABSTRACT

A switching mechanism for an electronic timepiece is disclosed. The switching mechanism comprises an external means for selectively activating an internal switching assembly. The external means is rotatably coupled to a grooved rod member which is in turn coupled to the internal assembly. Various contact arms disposed across the grooved rod member are adapted to become selectively disposed on various electrical contacts in the timepiece. By rotating the grooved rod member, these arms are selectively disposed on or off corresponding electrical contacts thus causing the internal switch assembly to be turned ON or OFF. By the use of the invented switching mechanism, various internal switching assemblies such as for alarm systems and the like may be easily activated and deactivated without the problems associated with prior art switching mechanisms.

18 Claims, 8 Drawing Figures

Fig. 1
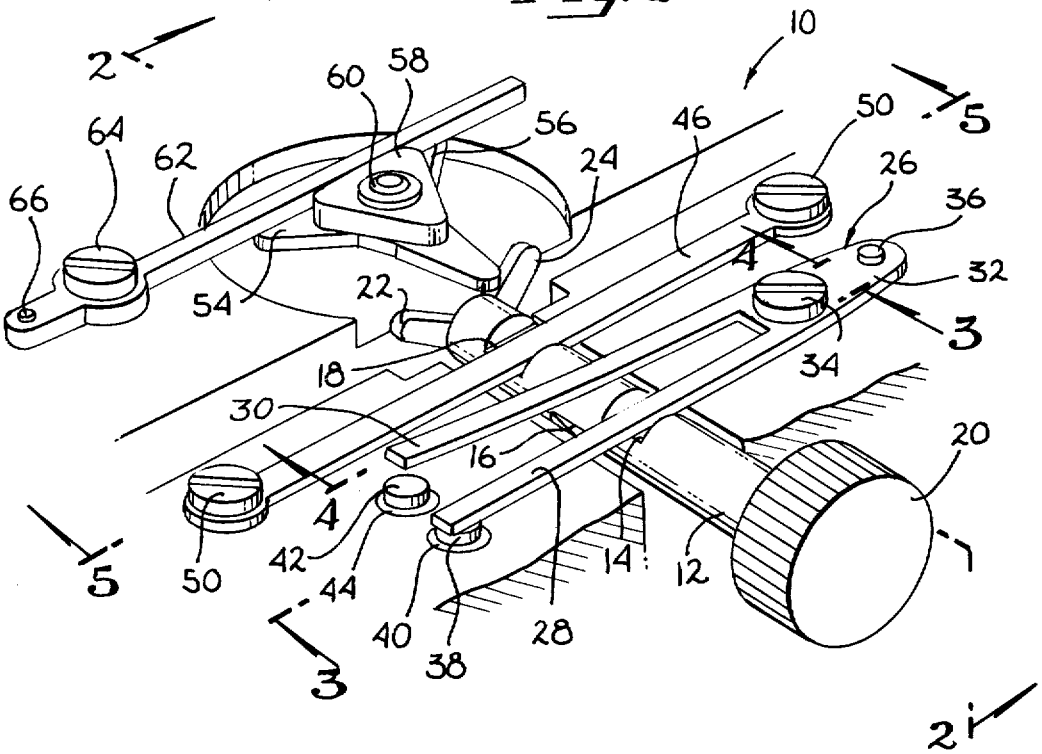
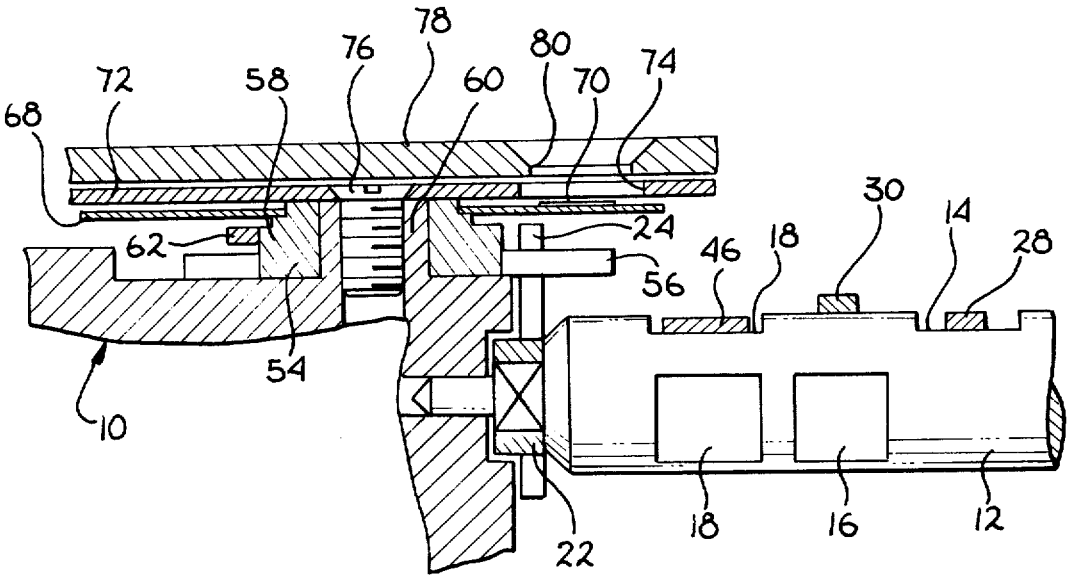
Fig. 2

SWITCHING DEVICE FOR ELECTRONIC TIMEPIECE

BACKGROUND OF THE INVENTION

1. Field of the Invention

The present invention relates to a switching mechanism for an electronic timepiece, and more particularly, to a switching mechanism which by rotation of an external means activates an internal switching assembly.

2. Prior Art

Prior art devices disclose electronic timepieces having external switching means such as winding stem to operate an internal switching assembly. Most often this type of switching assembly comprises a plurality of members which are manipulated by pulling or pushing an external operating means followed by a rotating action. The specific switching action is accomplished by rotating the external operating means clockwise or counterclockwise to a prescribed position. The disadvantage of this type of device is that in transition from one position to another, the external operating means must first be turned in a specific manner to revert it to its original position. Secondly, the stabilizers are moved to another stable position by pushing or pulling the external means. Finally, the external means is turned to a prescribed angle, necessitating extremely cumbersome multi-step operations. Further disadvantage involves the possibility of undesired results from such operations, high cost in manufacturing such a complex structure, and susceptibility to damage.

BRIEF SUMMARY OF THE INVENTION

One object of this invention is to provide a structurally simple switching mechanism for an electronic timepiece having an external operating means which has one or more stable positions in only the direction of axial rotation, and switching (ON/OFF) is accomplished by rotating the external means to a specific position without pulling or pushing.

Another object of this invention is to provide a switching mechanism in which the position of an internal switching assembly can be displayed on a display member coupled to the external means.

Still another object of this invention is to provide a switching mechanism for an electronic alarm clock in which the volume of alarm sound can be increased or decreased by rotating an external member.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWINGS

FIG. 1 is a perspective view of the switching mechanism of the present invention showing the grooved rod member and the associated contact arms disposed across the rod.

FIG. 2 is a cross-sectional view of the switching mechanism of the present invention taken along lines 2 — 2 of FIG. 1 showing the grooved rod member disposed in base plate 10 and coupled to the display 70.

DETAILED DESCRIPTION OF THE INVENTION

Figure 3:
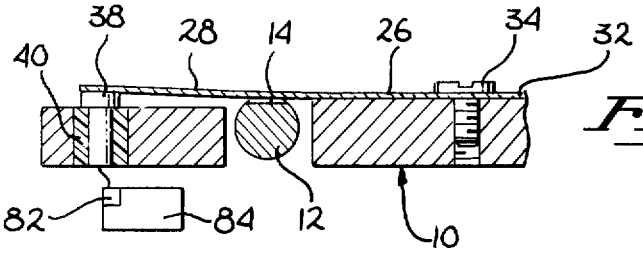
FIG. 3 is a cross-sectional view of the switching mechanism of the present invention taken along lines 3 — 3 of FIG. 1 showing the grooved rod member in a first position and the arm 26 disposed to contact 38.

Referring first to FIG. 1, a base plate 10 has disposed thereon an external rotatable crown 20 axially coupled to a grooved rod member 12. Two grooves 14 and 16 having an appropriate phase difference, about 120° in the presently preferred embodiment, are provided on the rod 12 in the direction of axial rotation and spaced along the axial direction. Three rotation regulating notches 18 are also provided on the rod 12 spaced in the axial direction from the grooves 14 and 16 and each of the three positioned at an angle, about 120° in the presently preferred embodiment, one of which is provided at a phase difference corresponding to that of grooves 14 and 16. Notches 18 can best be seen by reference to FIG. 5. A crown 20, such as is known in the art, is fixed to the exterior end of the rod 12, and an intermediate display wheel 22 is disposed on the interior end of the rod 12.

The internal switching assembly comprises the rod 12 and the various members which are disposed along the rod and which selectively operate various contacts or contact arms of the mechanism. In the present invention, a first movable member 26 has two arms 28 and 30 made of a flexible, conductive material and a base 32. The base 32 is fixed to the base plate 10 by a setscrew 34 and a pin 36 such that the flexible arms 28 and 30 intersect the rod 12 with each arm 28 and 30 selectively, fitting into the grooves 14 and 16 respectively. A convex contact 38 is provided on the base plate 10 through an insulating bushing 40 such that when arm 28 fits into the groove 14, arm 28 touches the contact 38 thereby completing an electrical connection and switching an electric circuit to an ON position as hereinafter discussed. A second convex contact 42 is provided on the base plate 10 through an insulating bushing 44. This contact 42 is activated when the arm 30 fits into the groove 16 and touches the contact 42.

A regulatory lever 46 made of a flexible material also intersects the axial line of the rod 12 with a middle portion of the lever fitting into the rotation regulating notches 18. This lever is fixed to the base plate 10 by joggling screws 50 at each end thereof.

Figure 6:
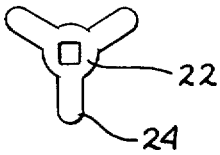
FIG. 6 is a plan view of the intermediate display wheel as seen in FIG. 1.

A display wheel 54, composed of three teeth 56 in a radial shape and a triangular cam 58 with each of the angular points disposed upon a portion of each tooth, is rotatably disposed around an axis 60 on the base plate 10. The teeth 56 couple and engage the teeth 24 of the intermediate display wheel 22. In the presently preferred embodiment, rotation of the rod 12 in a clockwise or counterclockwise direction causes the dislay wheel 54 to rotate, a rotation of approximately 120° of the rod 12 producing a rotation of approximately 120° in the display wheel 54. FIG. 6 shows the intermediate display wheel 22 having three teeth 24 in a radial shape. As shown in FIGS. 1 and 2, this wheel 22 is so disposed at the tip of the rod 12 that the standard position of the rod corresponds to the gearing position of tooth 56 of display wheel 54 and tooth 24 of the intermediate display wheel 22.

A control lever 62, fixed at one end to the base plate 10 by a setscrew 64 and a pin 66, flexibly contacts the cam 58. When the display wheel 54 turns once, the control lever 62 stabilizes the display wheel 54 into three positions each having a rotation angle of 120°.

Referring now to FIG. 2, a display panel 68 has display groups 70 of letters such as LOUD, SOFT, OFF or of colors denoting RED, BLUE, WHITE, provided thereon at equally spaced intervals. In the presently preferred embodiment, three such groups 70 are disposed on panel 68. This display panel 68 is fixed to the upper edge of the display wheel 54 by a calking or adhesive means. A bracing plate 72 is fixed to the base plate 10 by a set-screw 76 secured to axis 60. The bracing plate 72 has a hole 74 which aligns with one of the display groups 70 when the display wheel 54 is rotated into one of the three stationary positions, thus causing the display panel 68 to align with the hole 74. A dial 78 is shown as also having a hole 80 which aligns with the hole 74 thus permitting one to see the display 70 from the exterior of a timepiece.

Referring to FIG. 3, when the groove 14 is rotated to the upright position by a rotating action of the rod 12, the arm 28 drops into the groove 14 and the tip of the arm 28 touches the contact 38 thus establishing an electrical connection. In this embodiment, a resistor 82 which is electrically coupled to the contact 38 adjusts the volume of alarm sound in the alarm circuit 84 as hereinafter described in connection with FIG. 7. Of course other circuits having other functions are also within the scope of this invention.

Figure 4:
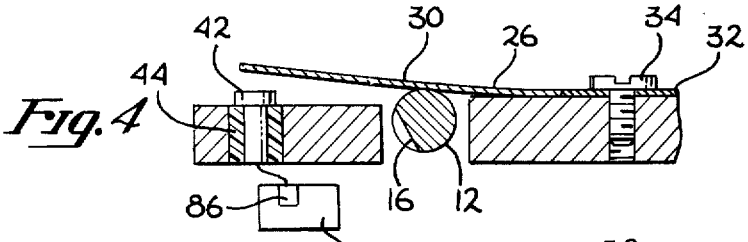
FIG. 4 is a cross-sectional view of the switching mechanism of the present invention taken along lines 4 — 4 of FIG. 1 and showing the grooved rod member rotated to a second position with contact arm 26 removed from contact 38.

FIG. 4 shows the arm 30 flexed into an upward position because of rod 12. Since the groove 16 is not in the upright position and the arm 30 is in contact with the rod 12, there is no electrical connection between the arm 30 and the contact 42. A resistor 86 for adjusting the volume of alarm sound is shown in the alarm circuit 84 (FIG. 7) which is electrically coupled to the contact 42 and is activated when the arm 30 is disposed on the contact 42 by rotation of rod 12.

Figure 5:
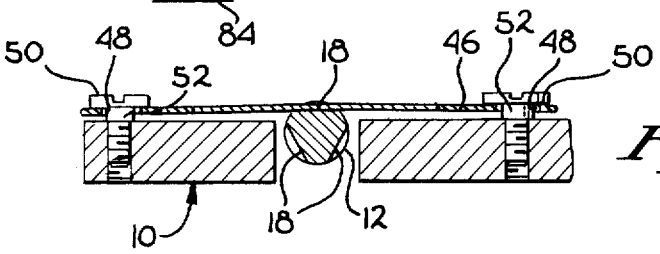
FIG. 5 is a cross-sectional view of the switching mechanism of the present invention taken along lines 6 — 6 of FIG. 1 and showing the regulatory lever 46 disposed on a flat area of the grooved rod member.

As shown in FIG. 5, two joggling screws 50 fix the regulatory lever 46 to the base 10; the bushing portion 52 of the screws being loosely inserted into the holes 48 at both ends of the lever 46. In this embodiment, the rod 12 is provided with three mechanically stationary positions. Rod 12 is stationary in three positions because the regulatory lever 46 rests upon the rotation regulating notches 18 provided on the rod 12. These notches 18 are disposed on the rod 12 at a phase difference of approximately 120° in the direction of axial rotation.

Figure 7:
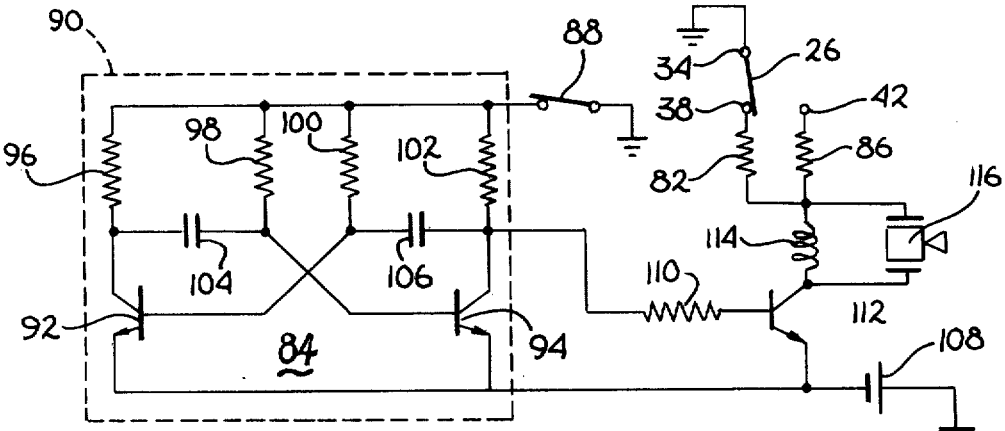
FIG. 7 is a circuit diagram used in an internal switching assembly for an alarm system.

In the presently preferred embodiment, an alarm circuit 84 is disposed in an electronic timepiece as shown in FIG. 7. An unlocking switch 88, disposed in the timepiece itself, is the type of contact switch which mechanically shuts or opens upon the setting of a preset time and the arrival of that time by the timepiece. The portion of the circuit surrounded by the broken lines is a known unstable multivibrator 90 composed of transistors 92 and 94, resistors 96, 98, 100 and 102, and condensers 104 and 106 which is coupled to a battery 108 by the unlocking switch 88. Oscillation signals from the unstable multivibrator 90 are transmitted to the transistor 112 by the transistor 94 and resistor 110. As can be seen in FIG. 7, the multivibrator 90 can selectively activate or deactivate the transistor 112. Coupled to the transistor 112 are a booster coil 114 and a piezo-electric buzzer 116 in a parallel arrangement. Volume-adjusting resistors 82 and 86 for the buzzer 116 are connected in a series configuration to the contacts 38 and 42 respectively. In the present embodiment of this invention, the resistance of resistor 86 is fixed at 2,000Ω and that of resistor 82 at 500Ω but the use of other resistance values are within the scope of this invention. The negative electrode of battery 108 is coupled to the emitter of each of the transistors 92, 94 and 112 while the positive electrode of the battery 108 is coupled to ground, that is, the movable member 26 via plate 10. Thus, the movable member 26, best seen in FIG. 1, is electrically coupled to the alarm circuit 84, and the arms 28 and 30 need only be disposed on contacts 38 or 42 to activate the circuit 84.

With the above described structure, the switching mechanism of the presently preferred embodiment operates as follows: When the rod 12 is in the position as shown in FIG. 1, arm 28 of movable member 26 is in contact with the groove 14 of rod 12 and is abutting contact 38. The regulatory lever 46 is also in contact with one of the regulating notches 18 thus holding the rod 12 in a stationary position. In this condition, a display 70, LOUD for example, on the display panel 68 can be visually seen through the peephole 80 provided on the dial 78. At this time the alarm circuit 84 has the resistor 82 having a smaller resistance than resistor 86 connected in circuit (as shown in FIG. 7). When the unlocking switch 88 is closed by arrival of the preset time a loud alarm sound is emitted.

Now, the rod 12 is rotated 120° in the clockwise direction or 240° in the counterclockwise direction. The rod 12 is now held by the regulatory lever 46 in a different stationary position than the one mentioned previously, whereby the arm 28 separates from the contact 38. The arm 30 now becomes disposed in the groove 16 and thus on the contact 42. Meanwhile, driven by the intermediate display wheel 22, the display wheel 54 is brought to another stationary position by the cooperation of the control lever 62 and the cam 58. The display 70 now indicates SOFT, for example, on the display panel 68 as visually seen through the peephole 80 provided on the dial 78. The alarm circuit 84 when activated, produces less noise than that previously described as the resistor 86 having a greater resistance than the resistor 82 is now connected in circuit.

Turning the rod 12 to a third position by clockwise or counterclockwise rotation of the rod 12 produces yet another result. As before, in this position, the rod 12 is held stationary by the regulatory lever 46. Both of the arms 28 and 30 are now disconnected from their respective contacts 38 and 42. Because rotation of the rod 12 causes the display wheel 54 to rotate as hereinbefore described, the display panel 68 is brought into a third position after being rotated. A display 70, OFF for example, on the display panel 68 can now be seen through the peephole 80. Since neither contact 38 nor 42 is in contact with arms 28 or 30, the alarm circuit 84 is deactivated. Thus, there has been described the use of an external means for selectively activating an alarm circuit in a timepiece, the alarm circuit being activated by the internal switching assembly selectively contacting contacts 38 and 42.

It is within the scope of this invention to employ toothed wheels for the intermediate display wheel 22 and the display wheel 54 used in this embodiment; to employ a click-stop device or the like instead of a control lever 62 for holding the display wheel 54 in stationary positions; to use various displays directly on the display wheel 54 by eliminating the display panel 68; and to provide a non-display portion on the display wheel 54 corresponding to one of the stationary positions.

In the event the plate 10 is made of non-conductive material the insulating bushings 40 and 44 may be eliminated. The base 32 of movable member 26 and one end of unlocking switch 88 are then directly coupled to the positive electrode of the battery 108.

Figure 8:
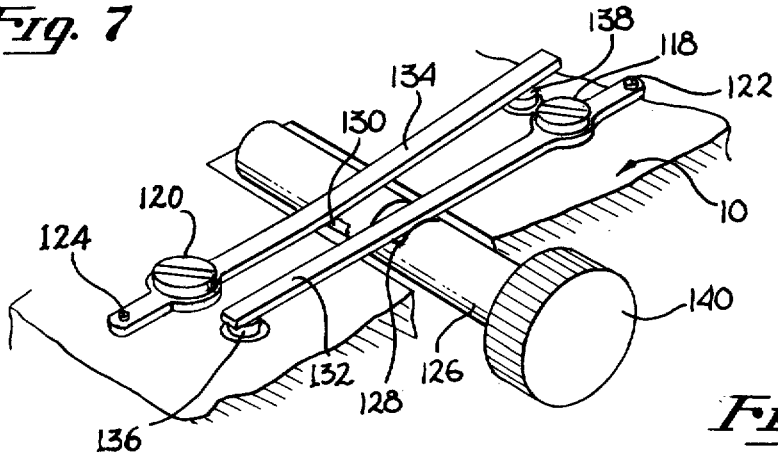
FIG. 8 is a perspective view of the switching mechanism in a second embodiment of the present invention.

In the presently preferred embodiment, the arms 28 and 30 each contacts the rod 12 from the clockwise direction. For this reason, when the rod 12 is rotated clockwise, a little more effort is needed than when the rod 12 is rotated counterclockwise. To minimize this difference in effort, the arms 28 and 30 are formed from a relatively low-resiliency material. Moreover, the degree of effort can be controlled by the use of different materials having different degrees of flexibility for the regulatory lever 46. It is also possible to equalize the amount of rotational effort by utilizing a switching device as shown in FIG. 8, the second embodiment of the present invention, in which two independent members 132 and 134 of a relatively high flexibility are provided; the opposing ends of the members being fixed to the base 10 by setscrews 118 and 120 and pins 122 and 124. In this embodiment, one member contacts the rod 126 from the clockwise direction and the other member from the counterclockwise direction. In this case, the regulatory lever 46 in the first embodiment shown in FIG. 1 may be eliminated. However, the grooves 128 and 130, contacts 136 and 138, and the crown 140 remain the same as in the first embodiment.

In the embodiments shown in FIGS. 1 and 8, the rod has three stationary positions in the direction of axial rotation, and two arms and corresponding contacts are provided. However, it is within the scope of this invention to provide, for example, one or more arms; or one or more stationary positions on the rod in the direction of axial rotation and a corresponding number of displays on the display wheel. Further, the use of the mechanism of this invention is not limited to switching the volume of an alarm sound; it can also be applied, for example, to correcting the time in an electronic timepiece with a liquid crystal display, to electronic circuits for erasure, and the like.

As described above, the switching mechanism of this invention accomplishes desired operations rapidly and with minimum rotation since the rod 12 is capable of turning 360° without the need of pulling or pushing the rod 12. Since the desired result can be visually confirmed by reading display panel 68, the possibility of errors is virtually eliminated. Additionally, the structural simplicity eliminated the need to assemble accessories such as clutch lever, setting lever, etc., minimizes the number of parts, limits the manufacturing steps to a simple processing of the rod, and provides an inexpensive switching mechanism.

Although this invention has been disclosed and described with reference to a particular embodiment, the principles involved are susceptible of other applications which will be apparent to persons skilled in the art. This invention, therefore, is not intended to be limited to the particular embodiment herein disclosed.

I claim:

1. A switching mechanism for a timepiece having at least one electronic circuit and an internal switching assembly, said mechanism comprising:

a movable rod for selectively moving said internal switching assembly, said rod having an internal segment inside of said timepiece and an external segment outside of said timepiece, said internal segment having at least two notches disposed along the length thereof, said external segment coupled to said internal segment such that when said external segment is moved, said internal segment is selectively moved into a plurality of predetermined positions;

said internal switching assembly having two flexible arm members, each said arm member extending transversely across said internal segment and engaging said internal segment of said rod such that when said internal segment is moved from a first predetermined position to a second predetermined position, one of said arms is disposed into one of two said notches and the end of said arm engages one of a plurality of electrical contacts coupled to said circuit thereby activating said circuit.

2. The switching mechanism according to claim 1 further including a display panel and wherein said internal segment has a movable segmented member coupled adjacent one end thereof, said movable segmented member having at least one tooth-like member arranged and configured to selectively couple said display panel to said internal segment such that movement of said internal segmented member causes said display panel to move into a predetermined position.

3. The switching mechanism according to claim 1 wherein said arm members are coupled together at one end thereof.

4. The switching mechanism according to claim 1 wherein a regulatory lever is disposed on said internal switching assembly, said regulatory lever yieldably engaging said internal segment of said rod so as to prevent said rod from movement until said external segment is moved.

5. The switching mechanism according to claim 4 wherein said lever selectively engages a third notched region disposed on said rod.

6. A switching mechanism for a timepiece having at least one electronic circuit and an internal switching assembly, said mechanism comprising:

a rotatable rod for selectively moving a plurality of arm members, said arm members coupled to said internal switching assembly such that rotation of said rod causing each said arm member to be disposed selectively in an upward and downward direction without substantially any lateral movement, said arm member extending transversely across said rod;

said internal switching assembly having at least one electrical contact coupled to said circuit, said contact disposed on said internal switching assembly and arranged and configured such that rotation of said rod causes one of said arm members to selectively engage the top of said contact and thereby activate said circuit.

7. The switching mechanism according to claim 6 wherein said arm members are coupled together at one end thereof.

8. The switching mechanism according to claim 6 wherein a regulatory lever is disposed on said internal switching assembly, said regulatory lever yieldably engaging said rod so as to retard said rod from movement.

9. The switching mechanism according to claim 8 wherein said lever selectively engages a notched region disposed on said rod.

10. The switching mechanism according to claim 6 wherein two said arm members are disposed on said internal switching assembly arranged and configured such that when one of said arm members is disposed upward, said other arm member is disposed downward and engages said contact.

11. The switching mechanism according to claim 10 wherein each said arm member extends transversely across said rod.

12. A switching mechanism for a timepiece having at least one electronic circuit and an internal switching assembly, said mechanism comprising:

a rotatable rod and a plurality of associated arm members disposed in said internal switching assembly, said rod for selectively moving at least one arm member from a first position to a second position, said arm members coupled to said internal switching assembly and to said rod such that said arm members extend transversely across said rod member, when said arm is disposed in said first position, said arm member engages the top of one of a plurality of electrical contacts disposed on said internal switching assembly and coupled to said electronic circuit thereby activating a predetermined portion of said electronic circuit, and when said arm member is disposed into said second position, said predetermined portion of said electronic circuit is deactivated, said arms being coupled to said internal switching assembly such that substantially no lateral movement of said arm members occurs, said rod further having a segmented, tooth-like member disposed at one end thereof, said segmented member having a plurality of outwardly extending teeth arranged and configured to selectively join a rotatable display panel to said rod such that movement of said rod causes said display panel to move into a predetermined position.

13. The switching mechanism according to claim 12 wherein said arm members are coupled together at one end thereof.

14. The switching mechanism according to claim 12 wherein a regulatory lever is disposed on said internal switching assembly, said regulatory lever yieldably engaging said internal segment of said rod so as to prevent said rod from movement until an external segment coupled to said rod is moved.

15. The switching mechanism according to claim 12 wherein said segmented member has three tooth-like members.

16. The switching mechanism according to claim 12 wherein two said arm members are disposed in said internal switching assembly, one of said arm members coupled to said internal switching assembly on one side of said rod and said other arm member coupled to said internal switching assembly on the other side of said rod.

17. The switching mechanism according to claim 12 wherein said electronic circuit includes an alarm device, said alarm device being selectively activated when said arm member engages a predetermined contact.

18. A switching mechanism for a timepiece having at least one electronic circuit and an internal switching assembly, said mechanism comprising:

a rotatable rod and a plurality of associated arm members disposed in said internal switching assembly, said rod for selectively moving at least one arm member from a first position to a second position, said arm members coupled to said internal switching assembly and to said rod, when said arm is disposed in said first position, said arm member engages one of a plurality of electrical contacts disposed on said internal switching assembly and coupled to said electronic circuit thereby activating a predetermined portion of said electronic circuit, and when said arm member is disposed into said second position, said predetermined portion of said electronic circuit is deactivated, said rod further having a segmented, tooth-like member disposed at one end thereof, said segmented member having a plurality of outwardly extending teeth arranged and configured to selectively join a rotatable display panel to said rod such that movement of said rod causes said display panel to move into a predetermined position; and a display wheel, said display wheel coupled to said display panel and selectively engaged by one of said tooth-like members disposed on said rod whereby rotation of said rod causes said display wheel to move said display panel into a predetermined position, and wherein a cam member is disposed on said display wheel and is yieldably engaged by a control lever, said control lever arranged and configured to selectively retain said cam in a predetermined position.

* * * * *